United States Patent [19]

Freberg

[11] 4,353,273

[45] Oct. 12, 1982

[54] PLIERS FOR PLASTIC RADIATOR TANK REPLACEMENT

[75] Inventor: Gerald A. Freberg, Omaha, Nebr.

[73] Assignee: Inland Manufacturing Company, Omaha, Nebr.

[21] Appl. No.: 202,303

[22] Filed: Oct. 30, 1980

[51] Int. Cl.[3] ..... B25B 7/02

[52] U.S. Cl. ..... 81/425 R

[58] Field of Search ..... 81/418, 425 AU, 426, 81/5.1 R

[56] References Cited

U.S. PATENT DOCUMENTS

| | | | |
|---|---|---|---|
| 1,585,903 | 5/1926 | McIntyre | 81/426 |
| 1,775,270 | 9/1930 | Bergman | 81/426 |
| 3,161,085 | 12/1964 | Pratt | 81/418 |
| 3,585,704 | 6/1971 | Schroeder | 81/418 |
| 3,872,747 | 3/1975 | Basile | 81/426 |

FOREIGN PATENT DOCUMENTS

| | | | |
|---|---|---|---|
| 1929 | of 1910 | United Kingdom | 81/418 |

*Primary Examiner*—James L. Jones, Jr.

*Attorney, Agent, or Firm*—Allegretti, Newitt, Witcoff & McAndrews

[57] ABSTRACT

Two pliers are disclosed which respectively can be utilized to detach and re-attach a plastic radiator header to the header plate of an aluminum radiator. The pliers for detaching or releasing the L-shaped locking tabs of the header plate from the plastic header include a special hook configured jaw adapted to grip and bend separate tabs. The pliers for re-attaching the header plate includes opposed, identical jaws each having a concave arcuate face adapted to engage and close separate locking tabs.

2 Claims, 11 Drawing Figures

PLIERS FOR PLASTIC RADIATOR TANK REPLACEMENT

BACKGROUND OF THE INVENTION

This invention relates to an improved pliers construction for detaching and re-attaching radiator headers or manifolds.

A radiator is commonly used in association with a cooling system of an internal combustion engine. Engine cooling fluid is circulated through the radiator to effect removal of heat from the engine.

Heretofore when a radiator has been damaged, it has been the practice to repair the radiator by replacing the damaged radiator tube or other portion of the radiator. Since radiators are commonly made from metal such as brass or aluminum, repair can be effected by metal welding or brazing techniques. Often radiators are constructed with a top header or manifold which connects with the various cooling tubes forming the radiator. In order to secure access to the internal tubes forming the radiator to effect repairs, it has been the practice to remove the top radiator header. Normally such headers or manifolds are brazed or soldered onto the radiator. Thus, their removal may be effected by appropriate application of heat or cutting tools. Of course, the header may be re-attached by an appropriate welding, brazing or soldering operation.

In recent years, however, it has been found that to reduce the weight of a radiator, it is possible to utilize a plastic header or manifold in association with metal, eg., aluminum radiator tubes. For many years European cars have used such a combination of aluminum and plastic for the fabrication of radiators. American automobile manufacturers beginning in 1980 introduced such composite radiator constructions.

Repair of the composite radiator constructions differs greatly from that of all metal radiators. Typically, the plastic header is held onto the aluminum radiator by means of a header plate having a series of locking tabs which bend over and engage a flange of the plastic header. In order to remove the plastic header and repair the radiator, each locking tab must be separately bent and removed from engagement with the flange of the plastic header. Since the locking tabs are aluminum, they may easily break if not handled correctly.

Thus, it has become necessary to design special tools which can be used to remove plastic headers from radiators and replace the headers once the radiator has been repaired. The alternative to affecting such a repair is total replacement of the composite radiator with a new radiator. This is an expensive process which would not be welcomed by the consumer. The present invention constitutes special pliers for removal and replacement or re-attachment of plastic headers on a metal radiator.

SUMMARY OF THE INVENTION

Briefly, the present invention comprises a special pliers for bending of a locking tab used to engage a header flange and thereby maintain a plastic header on a radiator and a special pliers used to replace the locking tabs in their original position. The pliers for bending the tabs to effect removal of the header includes an upper jaw with a hook member which engages the free end of the tab and a lower jaw which may be positioned against the metal header plate to thereby provide a fulcrum and permit manual rotation of the tab and release of the plastic header. The pliers for re-attaching the tabs includes substantially identical jaws wth arcuate opposed faces, one of which engages the tab and other of which bears against the metal header plate.

Thus it is an object of the present invention to provide improved pliers which may be utilized for release and replacement of plastic headers retained by a metal header plate of a radiator.

Another object of the present invention is to provide an improved pliers which is economical to manufacture and easy to use in the replacement and repair of plastic headers on metal radiators.

These and other objects, advantages, and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
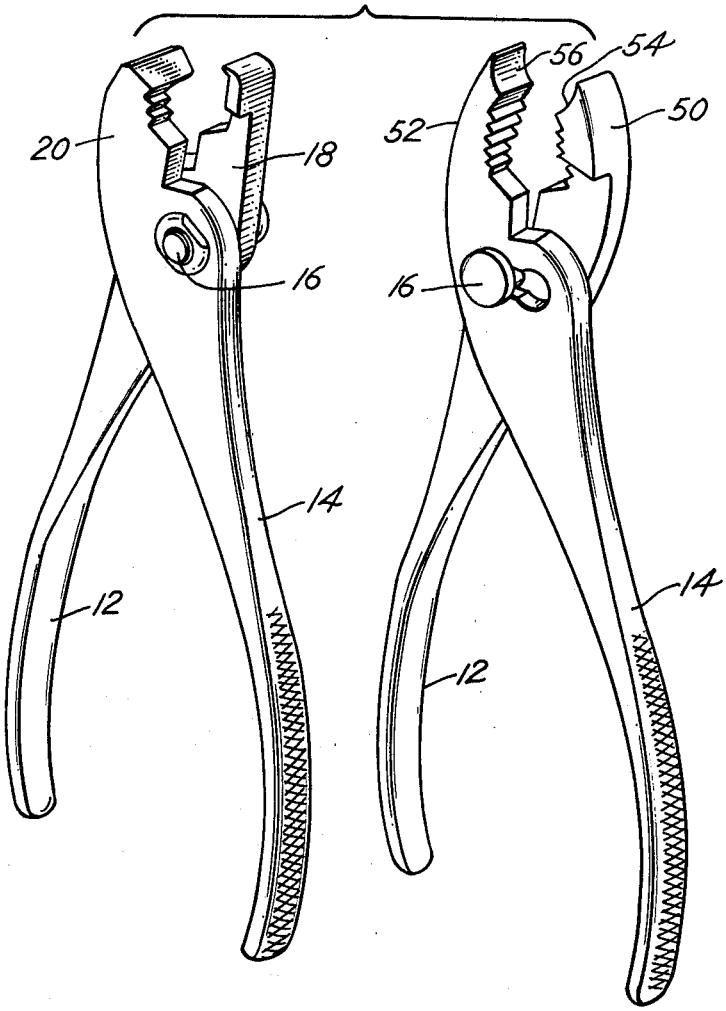
FIG. 1 is a perspective view of the pliers used for release of and the pliers used for re-attachment of header plate tabs.
Figure 2:
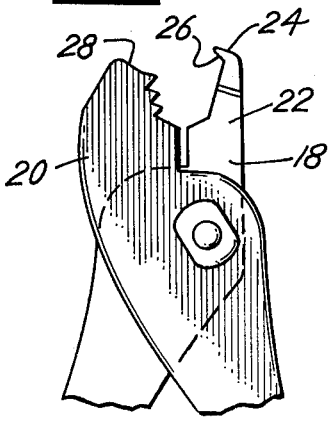
FIG. 2 is a side elevation of the pliers used for release of the header plate tabs.
Figure 3:
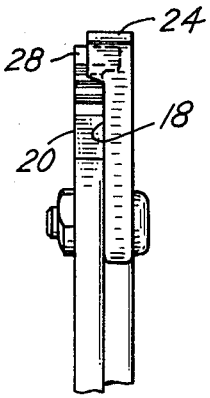
FIG. 3 is a top plan view of the pliers of FIG. 2.
Figure 4:
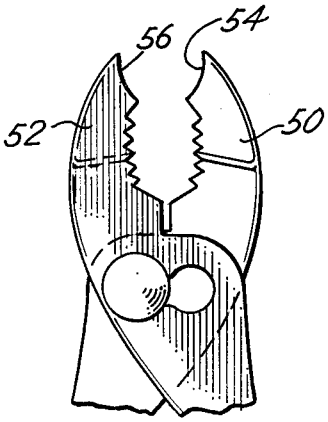
FIG. 4 is a side elevation of the pliers used for re-attachment of the header plate tabs.
Figure 5:
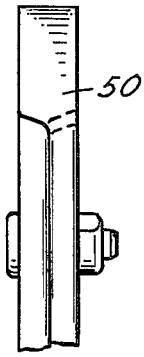
FIG. 5 is a top plan view of the pliers of FIG. 4.

In the following description and in the figures, it is noted that there are two special tools described which constitute the invention. FIGS. 1, 2, 3 and 6–8 illustrate the pliers construction for effecting release of the radiator header plate locking tabs. FIGS. 1, 4, 5 and 9–11 illustrate the pliers construction for re-attachment of the radiator header plate locking tabs. These constructions are discussed separately below.

Release Pliers Construction

The release pliers 10 includes a pair of opposed handle grips 12 and 14 which define pliers lever arms connected through a pivot axis or pin 16. The pliers 10 include an upper jaw 18 and a lower jaw 20. The upper jaw 18 includes a radially extending arm 22 which projects generally radially from the pivot axis 16. The arm 22 includes a depending end tang 24 which projects toward the lower jaw 20 from the outer end of arm 22. A land surface 26 is defined on the inside end of the tang 24.

The lower jaw 20 extends radially from axis or pin 16 and terminates with a generally planar land 28 that is parallel to the tang land 26. The teeth 30 of lower jaw 20, as shown in the figures, are not essential to the invention. The land 28 and the land 30 are generally equidistant from the pivot axis 16 and define planes which are separated about the distance of the length of the free end 31 of tab 40. This is illustrated in FIG. 7.

Figure 6:
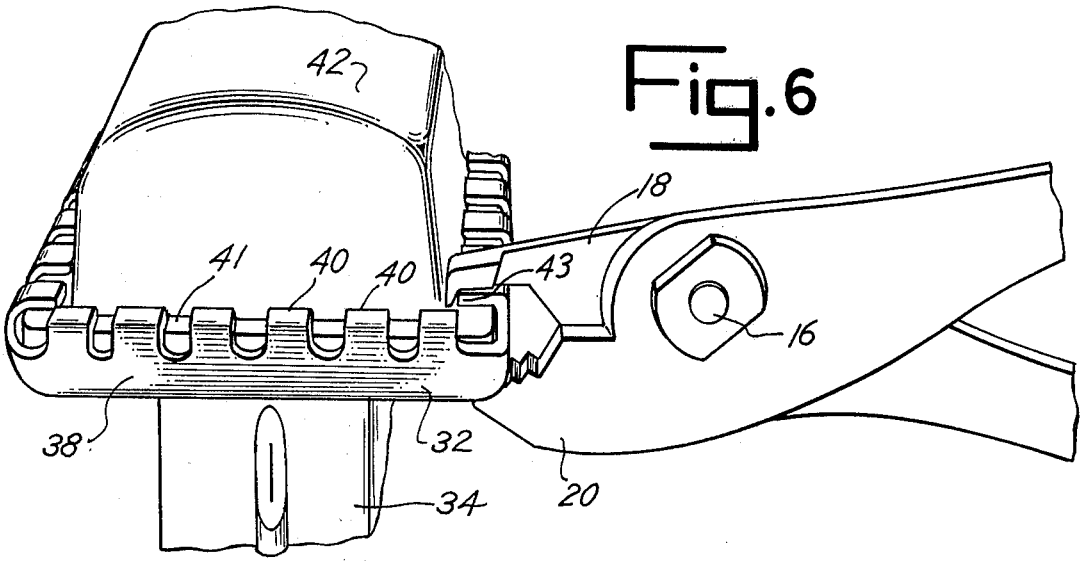
FIG. 6 is a perspective view illustrating the manner of use of the release pliers.
Figure 7:
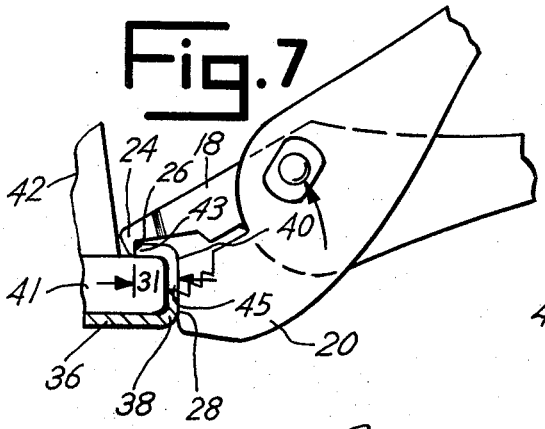
FIG. 7 is a side elevation of the pliers shown in FIG. 6.
Figure 8:
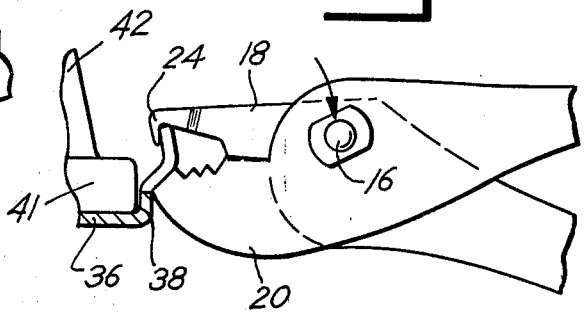
FIG. 8 is a further side view of the progressive removal of the header plate from the header.
Figure 9:
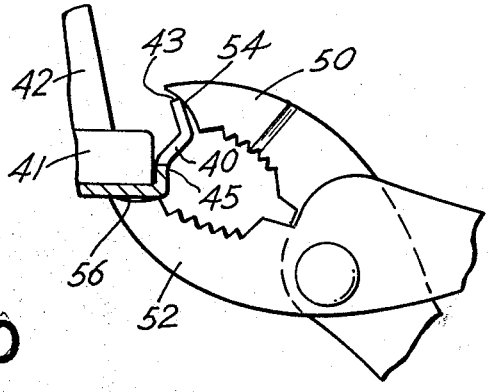
FIG. 9 is a side elevation of the manner of using the re-attachment pliers of FIGS. 4 and 5.

In operation, as shown by FIGS. 6–8, the land 28 is positioned against a portion of a header plate 32 which is affixed to the top of aluminum radiator 34. The header plate 32 includes a generally horizontal plate 36, an upwardly extending flange 38, and a plurality of L-shaped locking tabs 40 arranged peripherally around the flange 38 and bent over to engage a flange 41 of a plastic header 42. Tabs 40 have an outer end 43 and an opposite end 45 at the connection point to the flange 38. The upper jaw 22 and more particularly the tang or hook member 24 is engaged against the outer end 43 of tab 40. In particular, land 26 engages the outer end 43 of tab 40. The lower jaw land 28 is engaged against the flange 38 as shown in FIG. 7. This defines a fulcrum point. The pliers may then be manually gripped and pivoted in a clockwise sense as shown in FIG. 7 to the position shown in FIG. 8 thereby bending the tab 40 so as to release the flange 41 of the header 42.

With the construction of the pliers as shown, it has been found that the locking tabs 40 are released without excessive work hardening and without fracture. In this manner all of the tabs 40 may be released from the header flange 41 and the header 42 may be removed from the radiator 34.

Re-attachment Pliers Construction

Figure 10:
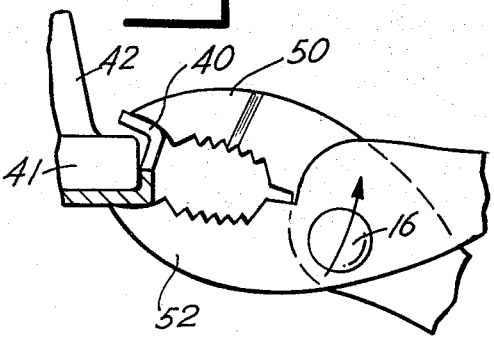
FIG. 10 illustrates a further step in the manual operation of the pliers of FIG. 9.
Figure 11:
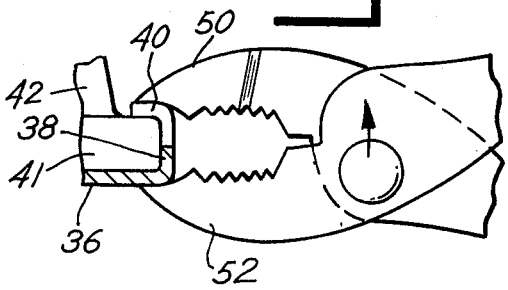
FIG. 11 is a side elevation illustrating the final step in the utilization of the pliers of FIGS. 4 and 5.

The reattachment pliers configuration includes generally identical and opposed jaws 50 and 52. The jaws 50 and 52 are substantially mirror images of each other. Each jaw 50 and 52 includes a concave opposed surface 54 and 56 respectively. The radius of the surfaces 54, 56 is approximately equal to one-half of the total length of tab 40, i.e., the distance between ends 43 and 45. This has been found to be an optimum configuration for the pliers. The surfaces 54 and 56 are adapted to engage the horizontal plate 36 of the header plate 32 and simultaneously engage the tab 40. In this manner the tab 40 may be gripped and twisted to its original position by counterclockwise motion of the pliers as shown in FIGS. 10 and 11 of the application.

The spacing between the surfaces 54 and 56 when the pliers is a generally closed position is substantially equal to the thickness of the header plate 32. Again, with the structure of the present invention, it is possible to reposition the tabs 40 of the header plate 32 on the header 42 with a minimum amount of work or fracture.

Thus, while there has been set forth a preferred embodiment of the above identified invention, it is to be understood that the invention shall be limited only by the following claims and their equivalents.

What is claimed is:

1. In a pliers of the type comprised of first and second generally straight pivotally connected members connected at a pivot axis to define opposed jaws and opposed parallel grips, the improvement of a jaw construction having opposed jaws pivotal about the pivot axis, said pliers adapted to engage and release an L-shaped tab member having an outer tab end and an opposite tab end, said jaws comprising, in combination:

an upper jaw member and a lower jaw member, said upper jaw member including a hook member, said hook member having an arm extending radially from the axis and a tang projecting generally transversely from the arm toward the lower jaw, said arm being substantially colinear with said attached handle grip, said tang being of substantially less thickness than said arm in the plane transverse to the axis, said tang including a generally planar tab engaging land forming an obtuse angle with and also intersecting a radius extending from the axis;

said lower jaw being without a tang and defining a substantially flat fulcrum land generally parallel to and spaced apart from the upper jaw tab engaging land, said fulcrum land spaced from the axis a substantially identical radial distance as the upper jaw tab engaging land and forming a surface parallel with the tab engaging land surface and spaced from the tab engaging land surface; and said upper jaw comprising means engageable with the outer tab end simultaneous with said lower jaw positioned at the opposite tab end to form a fulcrum point for bending the tab engaged by the hook member of the upper jaw upon a rotation of the pliers about the fulcrum point with the upper jaw moving in an arc about this lower jaw.

2. A jaw construction for pliers of the type having opposed jaws pivotal about an axis, said pliers adapted to engage and close an L-shaped tab member having a tab length, said jaws comprising in combination:

an upper jaw and a lower jaw, said jaws of generally identical configuration, each jaw including an opposed work engaging face at the end farthest from said axis, each jaw forming a mirror image of the other jaw, each of said faces defining a substantially quarter circular concave surface, the radius of said surface approximately equal to one-half of the locking tab length, the chord formed by tips of said concave surface forming an acute angle with and also intersecting a radius extending from the axis.

* * * * *